US006120727A

United States Patent [19]

Asaka et al.

[11] Patent Number: 6,120,727

[45] Date of Patent: Sep. 19, 2000

[54] MANUFACTURING METHOD OF SINTERED COMPOSITE MACHINE COMPONENT HAVING INNER PART AND OUTER PART

[75] Inventors: Kazuo Asaka, Matsudo; Tsuyoshi Kagaya, Kashiwa; Masahiro Suzuki, Tokyo, all of Japan

[73] Assignee: Hitachi Powdered Metals Co., Ltd., Japan

[21] Appl. No.: 09/396,066

[22] Filed: Sep. 15, 1999

[30] Foreign Application Priority Data

| | | | |
|---|---|---|---|
| Sep. 16, 1998 | [JP] | Japan | 10-261862 |
| Sep. 16, 1998 | [JP] | Japan | 10-261863 |
| Sep. 16, 1998 | [JP] | Japan | 10-261864 |
| Sep. 16, 1998 | [JP] | Japan | 10-261865 |
| Apr. 7, 1999 | [JP] | Japan | 11-100249 |
| Apr. 7, 1999 | [JP] | Japan | 11-100250 |

[51] Int. Cl.[7] ..... B22F 7/02; B22F 7/04

[52] U.S. Cl. ..... 419/6; 419/8

[58] Field of Search ..... 419/6, 8

[56] References Cited

U.S. PATENT DOCUMENTS

| | | | |
|---|---|---|---|
| 4,086,390 | 4/1978 | Mitani | 428/550 |
| 4,503,009 | 3/1985 | Asaka | 419/6 |
| 4,524,046 | 6/1985 | Suganuma et al. | 419/8 |
| 4,539,197 | 9/1985 | Asaka et al. | 419/16 |
| 4,578,317 | 3/1986 | Nakamura | 428/547 |
| 4,595,556 | 6/1986 | Umeha et al. | 419/8 |
| 4,907,330 | 3/1990 | Akao | 123/90.51 |
| 4,969,262 | 11/1990 | Hiraoka et al. | 29/888.1 |
| 5,659,876 | 8/1997 | Mizuta | 419/8 |

FOREIGN PATENT DOCUMENTS

| | | |
|---|---|---|
| 58-193304 | 11/1983 | Japan . |
| 2 320 032 | 6/1998 | United Kingdom . |

*Primary Examiner*—Ngoclan Mai
*Attorney, Agent, or Firm*—Jones & Askew

[57] ABSTRACT

Disclosed is a method of manufacturing a machine component of sintered ferriferous composite comprising an outer part and an inner part which is fitted into a hole of the outer part. It has the steps of: preparing one of the outer part and the inner part as a green compact of ferriferous powdered metal and the other as one of a green compact of ferriferous powdered metal, a sintered compact of ferriferous powdered metal and a mass of ferriferous molten metal; inserting the inner part into the hole of the outer part; and sintering the outer part and the inner part to bond the outer part and the inner part. The outer part and the inner part are prepared to have a fitting clearance of approximately −100 to +5 μm. When only the outer part is prepared as a green compact, the outer part is prepared to contain substantially no zinc, and the atmosphere at the sintering step is substantially non-carburizing atmosphere, and when the inner part is prepared as a green compact, the outer and inner parts are prepared so that only the inner part contains zinc, and the atmosphere at the sintering step is substantially carburizing atmosphere.

13 Claims, No Drawings

MANUFACTURING METHOD OF SINTERED COMPOSITE MACHINE COMPONENT HAVING INNER PART AND OUTER PART

BACKGROUND OF THE INVENTION

1. Field of the Invention

The present invention relates to a manufacturing method of machine components as a composite member, in which the machine component is prepared as plural sections divided therefrom and they are united into the whole machine component, and more particularly to a manufacturing method of machine components, which is suited to manufacture of machine parts by forming one part composed of green compact and another part composed of green compact or sintered compact or wrought steel according to a powder metallurgical technique, assembining them and bonding them by sintering to complete the machine part as a composite member, especially manufacture of machine parts having complicated shapes or being required to partially have a specific property.

2. Related Art

Manufacture of a machine part having a complicated shape or a machine component partially having a specific property has difficulty in forming it as a single part. In such a case, generally, the machine part is once splited and formed in plural sections, and they are combined into one body to manufacture as a composite part. A few methods are known as the means for bonding plural sections into one body, and a proper bonding method may be selected as occasion requires to utilize for manufacturing those machine parts as a composite component. However, the manufacturing method of machine parts in accordance with powder metallurgy is exceedingly excellent for manufacture of composite components.

In the manufacturing method of composite components by powder metallurgy, at least one of the plural split sections is formed of green compact, and other sections are formed of green or sintered compact or wrought steel, and they are bonded together by contacting and sintering. At this time, in order to obtain a firm joint, a mutual tight contact of joint surfaces is required at the time of sintering, and the joint profile of the conventional composite components are simple to be sectioned and bonded in flat planes.

However, in manufacture of composite components, it is often required to compose the component in a complicated joint profile such that one portion is inserted into other portion. For manufacture of such composite parts, the manufacturing method in accordance with powder metallurgy is suitable, and various composite parts are manufactured by using plural sections formed by compact molding.

In manufacture of a sintered component by combining plural green compacts, there is a general case wherein one green compact is formed into a shaft portion, and other green compact is formed into a shape having a hole for accommodating the shaft portion, and the green compact having the shaft portion (hereinafter called the inner green compact because it is on the inner side when fitting) and the green compact having the hole (hereinafter called outer green compact) are sintered in the state the shaft portion is fitted in the hole so that they are combined into one body by diffusion bonding. In this case, it should be noted that the amount of thermal expansion of the green compact during sintering depends on the chemical composition thereof, and, in order to enhance the joint strength, the chemical compositions of the both green compacts are selected so that the thermal expansion of the outer green compact may be smaller than that of the inner green compact to achieve sintering in the tight contact of the both green compacts.

For example, Fe—Cu green compact which is easily expanded by sintering is used for the inner green compact, and Fe—Ni green compact which easily shrinks by sintering is used for the outer green compact. In this method, since the chemical composition partially differs in the whole component, only a component having partially different properties is obtained.

As a measure of solving this problem, the inventor of the present application has previously disclosed in Japanese Patent Publication No. (Kokoku) 62-35442 that, even when materials of common chemical composition are used in the inner portion and outer portion, the purpose of enhancement of joint strength is achieved by setting the carbon content of the inner portion 0.2% higher than that of the outer portion, so that the inner portion is relatively expanded more to achieve tight contact of the both portions and promote bonding by solid-phase diffusion of alloy components.

By this previous invention, alloys of similar compositions can be used in the outer portion and inner portion. However, since the carbon is an element having a large effect on properties of iron alloy, it is not preferred that its content differs between the outer portion and inner portion.

Besides, such sintered composite machine components are manufactured by bonding green compacts, but it may be necessary to manufacture composite parts using sintered compact or wrought steel in one part, depending on the application of components, function or other requirements.

In particular, welding of sintered alloy and other material is generally avoided because its porosity acts negatively, and if welding is necessary, it is forced to employ an expensive method such as laser welding by using filler wire of a special composition. Accordingly, when sintered alloy member and steel or other material are bonded without use of welding, both members were fixed by keys by drilling key grooves in both or tightened by bolts by drilling holes in both. As described above, manufacture of composite members using wrought steel in one part and a green compact in the other part is very useful because it can extend the area in which weldable machine parts are possibly manufactured.

However, bonding of steel material and green compact, in particular, bonding at complicated joint surfaces including insertion is not easy as explained below.

The green compact during sintering shows dimensional changes due to allotropic transformation and heat, which is same as in the case of molten material. However, since the green compact is densified (or shrinks) in the sintering process due to change of gaps between powder particles, i.e., closing to form pores and losing in the pores, the amount of thermal expansion in ordinary sintering is smaller in principle as compared with that of the steel material or the sintered material of the same composition.

Therefore, if the outer portion is green compact and the inner portion is steel or sinter compact, the outer portion (green compact) relatively must shrink more to contact tightly with the inner portion (steel, sinter) so that the both portions would be bonded sufficiently. In fact, in the case of bonding two green compacts, the diffusion of components of the green compacts is promoted and a high joint strength is obtained. In spite of this, in the case of the inner portion being made of steel or sintered compact, the required joint strength is not obtained in the ordinary sintering condition designed for mass production. Even in this case, the joint strength is possibly improved by changing the sintering conditions so as to sinter them at high temperature for a long time. However, such a change is difficult to put into practice from the aspects of production efficiency and cost.

As the countermeasure, there has been developed a bonding method in which the joint surface of the steel member is subjected to carburizing process before fitting with the green compact. This method makes use of the following phenomenon: that is, when a carburized layer of a carbon content higher than that of the green compact is formed on the steel surface, the expansion amount of the steel increases, and the diffusion of carbon from the carburized layer to the green compact is promoted sufficiently when sintering, and a high joint strength as in the case of two green compacts is obtained.

However, this method requires a long time of carburizing process by the ion carburizing method or the like, and the treating cost of steel material is high. Moreover, it cannot be applied to a material which is not suited to carburizing or an occasion where carburization is not preferred. Therefore, the scope of application is limited.

Further, in the case of the outer portion made of steel or sintered compact and the inner portion made of green compact, since the inner portion (green compact) relatively shrinks more to occure dissociation from the outer portion (steel, sintered compact), and bonding by sintering is more difficult than in the case mentioned above.

Besides, when bonding is made to sintered part to other part, application of welding had been avoided, because the sintered compact is not suited to welding with other members due to its porosity and other properties. Therefore, if a composite member using steel material is manufactured easily, it is possible to manufacture machine parts having both of the benefit of the sintered product and the benefit of the steel material which is suited to welding.

SUMMARY OF THE INVENTION

With these problems in mind, therefore, it is the primary object of the invention to provide a manufacturing method of machine components capable of controlling the dimensional changes of the inner portion and outer portion formed of green compacts during sintering without changing the basic chemical composition or blending content of the graphite, and bonding the both portions favorably.

It is the secondary object of the invention to provide a manufacturing method of composite components, in which no carburizing process of steel material is required for bonding of green compact by sintering, and which is particularly applicable to a combination of one portion of wrought steel or sintered metal and the other portion of green compact.

It is the third object of the invention to provide a manufacturing method of machine components that can be welded to other members while maintaining the advantages of powder metallurgy.

It is the fourth object of the invention to provide a manufacturing method of composite components for manufacturing composite components by bonding green compact and sintered compact by sintering.

The method of manufacturing a machine component of sintered ferriferous composite comprising an outer part having a hole and an inner part having a shaft which is fitted into the hole of the outer part, according to the present invention, comprises the steps of: preparing one of the outer part and the inner part as a green compact of ferriferous powdered metal and the other as one of a green compact of ferriferous powdered metal, a sintered compact of ferriferous powdered metal and a mass of ferriferous molten metal; inserting the shaft of the inner part into the hole of the outer part; and sintering the outer part and the inner part to bond the outer part and the inner part, wherein the outer part and the inner part are prepared to have a fitting clearance of approximately −60 to +5 $\mu$m, and when only the outer part is prepared as a green compact, the outer part is prepared to contain substantially no zinc, or the atmosphere at the sintering step is substantially non-carburizing atmosphere, and, when the inner part is prepared as a green compact, the outer and inner parts are prepared so that only the inner part contains zinc, and the atmosphere at the sintering step is substantially carburizing atmosphere.

In another aspect, the method of manufacturing a machine component of sintered ferriferous composite comprising an outer part having a hole and an inner part having a shaft which is fitted into the hole of the outer part, comprising the steps of: preparing both of the outer part and the inner part as a green compact of ferriferous powdered metal; inserting the shaft of the inner part into the hole of the outer part; and sintering the outer part and the inner part to bond the outer part and the inner part, wherein the outer part and the inner part are prepared to have a fitting clearance of approximately −100 to +5 $\mu$m, the outer part contains substantially no zinc but the inner part contains zinc, and the atmosphere at the sintering step is substantially carburizing atmosphere.

In further aspect, the method of manufacturing a machine component of sintered ferriferous composite comprising an outer part having a concaved portion and an inner part which is fitted into the concaved portion of the outer part, according to the present invention, comprises the steps of: preparing one of the outer part and the inner part as a green compact of ferriferous powdered metal and the other as one of a green compact of ferriferous powdered metal, a sintered compact of ferriferous powdered metal and a mass of ferriferous molten metal; inserting the inner part into the outer part; and sintering the outer part and the inner part to bond the outer part and the inner part, wherein the outer part and the inner part are prepared, with use of dilatometric curves of the outer part and the inner part, to produce at the sintering step an intereference by a relative expansion of the inner part to the outer part such that the outer part and the inner part are tightly fitted to each other at least temporary in a temperature range of approximately 750° C. or above.

The features and advantages of the manufacturing method according to the present invention over the proposed conventional methods will be more clearly understood from the following description of the preferred embodiments of the present invention.

DETAILED DESCRIPTION OF THE PREFERRED EMBODIMENTS

In manufacture of a composite component in which plural sections are separately formed and then combined into one body, the joint portion possibly includes a fitting or insertion. For example, one part is formed to have an axial protrusion, and the other part has an axial hole into which the protrusion of said one part is inserted and bonded. Or, in another case, one part has an inner bore or a hole, in which the other part is entirely accommodated and fitted. When such a fitting portion is made to manufacture the composite machine component, if green compact is used in at least one part in accordance with powder metallurgy, it is hard to form a joint as compared with the case of a flat joint.

When two parts at least one of which is formed of green compact are bonded by assembling and sintering them, it is required that the bonding surfaces should be in tight contact during sintering so that solid-phase diffusion can be promoted between the bonding surfaces during sintering.

Since solid-phase diffusion takes place at temperature of about 750° C. or higher in ferriferous metals (pure iron, iron alloy), the bonding surfaces must contact with each other at least temporarily in the temperature range of about 750° C. or higher, preferably 800° C. or higher.

Elements for causing tight contact of the bonding surfaces include:

1) the pressing force occurring between the bonding surfaces of two parts due to dimensions settled for the joint portion, and
2) the pressing force occurring relatively between the bonding surfaces by dimensional changes due to thermal expansion or shrinkage during sintering.

Generation of the pressing force of 1) requires press-fitting of the inner part into the outer part, and the obtainable effect is somewhat limited in order to prevent breakage of the green compact. Therefore, it is desired to obtain additional effects by the pressing force of 2) and solid-phase diffusion, depending on the difficulty of junction. That is, the bonding surfaces should contact with each other at least temporarily during sintering, specifically at 750° C. or higher, preferably at 800° C. or higher, and it is preferred to contact so as to produce a pressing force between the both surfaces.

The most important factors affecting the pressing force of 2) includes dimensional change accompanying to the sintering. This dimensional change appears as a synthetic result of: shrinkage of green compact due to sintering; thermal expansion of the material; and expansion due to carburizing, each of which occurs independently during the sintering. Carburizing is induced by the carbon contained in the green compact or carburizing components in the sintering atmosphere. Moreover, carburizing can be promoted by catalyst or other components. Therefore, if the outer part (the portion having the inner bore or hole for fitting) of a composite component is composed of green compact, the condition must be set so that shrinkage of this green compact may not be suppressed due to carburizing, that is, the carburizing may not be promoted, and if the inner part (the portion having a protrusion for fitting or the portion to be inserted entirely) is composed of green compact, the condition must be set so that the shrinkage of this green compact may be suppressed, that is, the carburizing may be promoted, so that the pressing force of 2) can be relatively obtained. This can be realized by measuring dilatometric curves of the inner part and the outer part. The dimensions and compositions of both parts and sintering conditions are determined to appropriately promote or inhibit carburization and expansion of each part in such a manner that the intereference between both parts which is estimated from the dilatometric curves reaches about 60 μm to 200 μm at least temporary in the range of about 750° C. and above.

Explained below are the cases in which the outer part is composed of green compact, the inner part is composed of green compact, and both parts are composed of green compact. In this specification, the term "steel" generally refers to pure iron, carbon steel, alloy steel, and other ferriferous metal materials which are substantially non-porouse or dense like ingot, i.e. molten metal, and a steel part can be prepared by shaping (e.g. working, forging, machining, etc.) ingot steel. In the description of the chemical composition and others, the unit "%" refers to the percentage by weight unless otherwise noted.

(A). Composing the Outer Part as Green Compact

When sintering the outer part of green compact and the inner part of steel or sintered compact which is fitted into the outer part for bonding, in order to have a high joint strength in the obtained composite part, it is required to bond them not only by the fixing force due to mere shrink fit, but also by solid-phase diffusion of the alloy components by sintering in the sufficiently contacting state of the joint surfaces of the two members. For this purpose, in the first place, what is important is the fit clearance (i.e., the difference between the inside diameter of the bore portion of the outer part and the outer diameter of the shaft portion or fitting portion of the inner part) when fitting the both bonding portions, and it is preferred to press-fit the inner part by setting smaller the hole of the outer part which is the green compact (for interference fitting). The larger the intereference, the higher is the degree of contact between the two members. However, in order to avoid breakage of the green compact which is low in strength before sintering, it is necessary to set the intereference (i.e., minus fit clearance) smaller than in the case of two green compacts having a buffering action, at least within 60 μm, preferably within 30 μm. In the case of through fitting, the gap (fit clearance) should be as small as possible, preferably 5 microns or less. Therefore, the fit clearance is set in a range of −60 to +5 μm, preferably −30 to +5 μm.

The next factors are the type of atmosphere for sintering and the relation between the atmosphere and the type of the powder lubricant blended in the green compact. The details will be described below.

In general, as the sintering atmosphere for ferriferous alloy, the refined exothermic gas prepared by denaturing natural gas or hydrocarbon of methane series is widely used because they are suited to Fe—C alloys of high carbon content and there is no particular repellent property, and zinc stearate is generally used as the powder lubricant.

However, if such atmosphere (that is, butane denatured gas or the like) is used in the case of sintering for a composite of green compact used in the outer part and steel or sinter used in the inner part, carbon (or a carburizing component) in the atmosphere possibly invades into the pores from the surface of the green compact to induce carburizing reaction, and that expands the green compact a little. Moreover, at this time, if zinc is present in the green compact, only a trace would acts as a catalyst relating to this reaction to further increase the amount of expansion. Due to such expansion, the contact between the green compact and the steel becomes insufficient, and the joint strength is lowered.

Therefore, as the countermeasure, it must be basic to change the atmosphere gas to non-carburizing gas. In this case, considering also the economy, almost inert nitrogen gas atmosphere or atmosphere mainly composed of nitrogen gas is particularly preferred among various non-carburizing gases. Alternatively, the green compact of the outer part is prepared so as not to contain zinc substantially. If using powder lubricant, it is further preferred to use zinc-free lubricant such as lithium stearate, other metal stearate than zinc or Acra-Wax (tradename of a product composed of ethylene-bis-stera-amid, $(C_{17}H_{35}CONH)_2(CH_2)_2$) in order to decrease expansion.

In the case that the inner part is a sintered compact which receives the action of the carburizing atmosphere to the same extent as the green compact of the outer part, expansion due to carburizing occurs in both parts. Therefore, even if they are sintered in the carburizing atmosphere, the outer part can shrink relatively by the intrinsic shrinkage of the green compact, unless the green compact of the outer part contains zinc. As a result, a certain degree of joint strength is obtained.

Usual sintering is solid-phase sintering, but if sintering proceeds into a state that a liquid phase is partly formed, the diffusion bonding is further promoted. Therefore, it is preferred for manufacture of composite component to sinter them into a state of forming liquid phase. In such a case, when the production of liquid phase is within 5%, there is no fear of erosion or deformation, but it is preferred to keep within 3% in order to keep the dimensional precision of the sinter in a favorable state.

It is unnecessary to particularly limit the chemical position of the outer part, because the requirement for the outer part simply resides in that the amount of thermal expansion during sintering is smaller than that of the inner part. Therefore, it may be of pure iron or of substantially the same composition as that of the inner part. Alternatively, as far as the amount of thermal expansion is not increased from that of the inner part, proper metal components may be added as required.

(B). Composing the Inner Part as Green Compact

When the inner part of green compact is fitted to the outer part of steel or sintered compact and sintered for bonding, in order to have a high joint strength in the obtained composite pomponent, it is firstly required the same as in the case of the outer part composed of green compact, to bond them not only by the fixing force due to mere shrink fit, but also by solid-phase diffusion of the alloy components by sintering in the sufficiently contacting state of the joint surfaces of the two members. Therefore, what is important is the fit clearance (i.e., the difference between the inner diameter of the hole portion of the outer part and the outer diameter of the shaft portion or fitting portion of the inner part) when fitting the both bonding portions, and it is preferred to press-fit the inner part into the hole of the outer part by setting slightly larger the inner part which is the green compact (for interference fitting). The larger the intereference, the higher is the degree of contact between the two members. However, in order to avoid breakage of the green compact which is low in strength before sintering, it is necessary to set the intereference smaller than in the case of two green compacts having a buffering action, at least within 40 $\mu$m, preferably within 30 $\mu$m. In the case of through fitting, the gap should be as small as possible, preferably 5 $\mu$m or less. Therefore, the fitting clearance is set in a range of −40 to +5 $\mu$m, preferably −30 to +5 $\mu$m.

The next important factors are dimensional behaviors (expansion, shrinkage) of parts during sintering. The details will be described below.

Solid-phase diffusion takes place in a high temperature range of about 750° C. or more in ferriferous metals, and if the amount of expansion of the green compact in this temperature range becomes larger than the amount of expansion of the steel or sintered compact, the outer part of steel or sintered compact relatively tightens the inner part of green compact, so that the both members contact tightly with each other. In this state, sintering of the green compact and solid-phase diffusion of alloy components are promoted, and the both parts are combined into one body, and a high joint strength is obtained.

However, since the green compact is densified (or shrinks) in the sintering process due to change of gaps between powder particles, i.e., closing to form pores and losing in the pores, the amount of thermal expansion in ordinary sintering is smaller in principle as compared with that of the steel and sintered material of the same composition. Therefore, the inner part (green compact) shrinks relative to the outer part, and that acts to loosen the contact with the outer part (steel or sintered compact), so that the joint strength is lowered.

In the present invention, therefore, measures for increasing the amount of thermal expansion of the green compact more than that of the steel or sintered material in the high temperature region of 750° C. or more, preferably 800° C. or more is provided so that the steel or the sintered compact and the green compact are in the contact state during sintering, in order to improve the joint strength. Such measures include, as specifically described below, (1) use of so-called "Copper growth phenomenon" in sintering of ferriferous green compact, (2) higher content of carbon (graphite) in the green compact by 0.2% or more than the carbon content in the steel or sintered compact, and (3) sintering in carburizing atmosphere with use of the green compact to which zinc is preliminarily added. Usual sintering is solid-phase sintering, but if sintered in a state that a liquid phase is partly formed, diffusion bonding is further promoted. Therefore, it is suited to control the sintering so that the production of liquid phase is within 5%, preferably within 3%.

First, the "Copper growth phenomenon" occuring when a green compact blending copper to iron is sintered is such phenomenon that copper invades into the lattice of iron to expand it, and this expansion cancels the shrinkage by sintering so that the expansion amount of the green compact in the high temperature region is larger than that of steel and sintered material. In this case, the expansion by copper is very strong above the melting point of copper (i.e., above 1,083° C.). This action is significant when the copper is blended at a content of 1% or more. It is preferred to blend 2% or more of copper for achieving diffusion bonding by keeping sufficient contact between two parts. This action varies depending on other alloy components aside from the blending content of the copper itself. For example, aluminum, sulfur and lithium act to enhance the expansion, while boron, carbon and phosphorus act to suppress expansion. Therefore, by properly selecting the composition, the expansion may be controlled to a desired amount.

The action and effect of increasing the carbon content of the green compact are as follows.

In the process where the green compact is heated to expand, if sintering of iron begins, the amount of thermal expansion is canceled by the amount of shrinkage due to sintering. However, since carbon delays the progress of sintering of iron, the shrinkage is slower when the graphite content is higher, so that the amount of expansion increases. Moreover, carbon invades into the iron lattice and diffuses. Therefore, if carbon is only diffused in the iron, the lattice constant of iron is increased and the amount of expansion increases on the whole. Furthermore, the point of transformation from $\alpha$-iron to $\gamma$-iron which is induced by temperature rise and leads to shrinkage is shifted to the lower temperature side when the carbon content is higher. Since the coefficient of expansion is greater in the $\gamma$-phase than in the $\alpha$-phase, the transformation from $\alpha$-phase to $\gamma$-phase is faster when the carbon content in the green compact is greater. Therefore, shrinkage in the high temperature range can be avoided and the expansion increases by higher carbon content of the green compact. Owing to such reason, it has been empirically found that, when the carbon content is higher than in the steel material by 0.2% or more, the amount of thermal expansion of the green compact in high temperature range is made to be higher than in the steel material, This expansion of the inner part by carbon can be also caused by using carburizing gas in the sintering atmosphere. Since the green compact is basically porous, the inner part of green compact can contact with the sintering atmosphere, and carburizing from the atmosphere gas easily progresses to the inside of the green compact, while the steel or sintered compact contacting with the atmosphere gas is limited substantially to only the outermost surface and it is hardly carburized.

Accordingly, if ferriferous green compact containing zinc as in the case (3) is sintered in carburizing atmosphere, zinc shows a catalytic action for taking up the carbon component in the atmosphere onto the iron surface in relation to the reaction between iron and carbon component in the atmosphere, even when contained slightly, and the amount of thermal expansion during sintering is made to be greater, as compared with the case not containing zinc at all. Zinc can be simply added, but if it is added in a form of zinc stearate serving also as powder lubricant necessary for molding, that saves labor and is preferable for dispersing the zinc uniformly. As the carburizing sintering atmosphere, refined exothermic gas prepared by denaturing natural gas or hydrocarbon of methane series, for example, carburizing butane denatured gas is suited.

Throughout the measures (1) to (3), it is preferred that both parts are maintained in a tight contact state in the whole range of about 750° C. or higher in the sintering process, but it is not absolutely required, but a sufficient bonding is possible if contacting at least in part of this temperature range (for the time until the depth of diffusion of alloy component reaches about 5 μm although the required time varies with the temperature).

The above method of manufacturing the composite component from the outer part of steel and inner part of green compact is useful for manufacturing solenoid valves. According to the above method, a favorable solenoid valve can be manufactured thorough the steps of: forming the valve shaft corresponding to the outer part of the solenoid valve by using steel material; forming the movable iron core corresponding to the inner part by using green compact; and assembling them and bonding by sintering.

(C). Composing the Both Parts as Green Compact

Basically, machine components composed from two parts of green compact can be manufactured with reference to the manufacturing process described in the above section (B). Here, an advantageous embodiment in which the difference in chemical composition can be reduced between two parts to increase uniformity of chemical and mechanical behavior will be described.

When ferriferous green compact containing zinc, even if it is contained slightly, is sintered in carburizing atmosphere, zinc shows a catalytic action in relation to the reaction between iron and carbon in the atmosphere, and the dimensional changes during sintering are then larger as compared with the case not containing zinc at all. Though zinc stearate (Zn-st) is generally used as the powder lubricant to be added to the material powder, there are still various lubricants not containing zinc such as metal salts other than zinc, specifically, lithium stearate (Li-st), Acra-Wax (tradename) and the like. Therefore, if the powder lubricant to be used is appropriately selected from them, it is possible to make a different between the dimensional changes of the green compacts without substantial difference in the properties of the sintered products of two green compacts.

Specifically, using zinc stearate as a powder lubricant for the material powder of the inner part and a zinc-free powder lubricant for the material powder of the outer part, the both fitted parts are sintered in carburizing atmosphere. According to this construction, the dimensional changes differ even if the content of graphite blended is the same in the two parts, and the sintering is promoted in the state of the outer part tightening the inner part. In this case, it is also possible to add zinc as a simple matter. However, when it is added in a form of zinc stearate serving also as required powder lubricant, it saves labor and is preferable for dispersing uniformly. As the atmosphere, refined exothermic gas prepared by denaturing natural gas or hydrocarbon of methane series (for example, carburizing butane denatured gas) is suitable.

In the case of sintering of two ferriferous green compacts, a sufficient bonding is possible if both members in the sintering process contact with each other at least in part of the high temperature range of about 750° C. or more, preferably about 800° C. or more, or, for the time until the depth of diffusion of alloy component reaches about 5 μm (although the required time varies with the temperature). Usual sintering is solid-phase sintering, but the diffusion bond is further promoted when sintered in a state of producing liquid phase in part, and such sintering is preferred. In such a case, if the production of liquid phase is within 5%, there is no fear of erosion or deformation. It is preferred to keep within 3% in order to keep the dimensional precision of the sintered product in a favorable state.

The action of zinc is concerned in the reaction of taking up the carburizing components in the atmosphere onto the iron surface and forming cementite. Therefore, if the atmosphere is not carburizing, even the green compact containing zinc does not cause action or effect of increasing the expansion amount. In this connection, if the atmosphere is carburizing, the amount of expansion of the green compact slightly increases, even when no zinc is contained. However, since expansion occurs similarly in both outer part and inner part, relative difference does not occur, so that there is no effect on the bonding effect. If both parts contain zinc and the atmosphere is carburizing, the amount of expansion increases but relative difference does not occur, and the result is the same.

For enhancement of bonding strength, the fit clearance when the both parts are fitted is also important, and it is preferred to set the inner part slightly larger (interference fitting) to press-fit it into the outer part. The larger the intereference is, the higher is the degree of contact. However, in order to prevent the outer part which is low in strength before sintering from being broken due to excessive tensile stress, the intereference should be preferably kept within 100 μm. In the case of through fit, the gap should be as small as possible, and should be kept under 5 μm. Therefore, the fit clearance is set to be in a ragen of −100 to +5 μm.

(D). Applications of Composite Components

Major features of powder metallurgy in manufacture of machine parts include efficient and inexpensive mass production of uniform products as compared with cutting or other machine processing, and also include use of properties such as oil impregnating ability, light weight, etc., which are peculiar to sintered alloy, owing to the porosity, and which are not seen in products made from ingot or wrought materials, as advantages of the obtained products (sintered components). However, welding of sintered part and other member is generally regarded unsuited because the porous property acts negatively.

The reasons are as follows: it is inferior in conductivity of heat and electricity due to porous property; the gas easily remains in the pores and blow holes are likely to occur in the welded portion; and cracks are likely to occur during the welding due to transformational distortion because of high carbon content generally required for application in machine parts.

Description will be made below for the case of an internal gear pump will be described below as an example of a machine component having a shape suited to manufacture by powder metallurgy. Internal gear pump has an inner rotor (outer gear), and it has an inside shaft hole which has a relatively simple shape, but it also has ouside tooth which has a complicated profile such that the powder compacting is more useful than the machining process (tooth cutting) for forming it. To the contrary, in the case of the outer rotor (inner gear), powder compacting is desired for forming the inside tooth profile, but it is not necessary for the outside portion having a simple shape. A toothed pulley is also known as a machine part of the same properties as the inner rotor.

In the case of such a machine part as above, complicated portions are manufactured by powder metallurgy, and other portions are made of wrought materials suited to welding, and if both portions are firmly bonded, the whole machine part achieving the designed object is obtained. This can be realized by employing the manufacturing method of composite components explained in the sections (A) and (B) above, and composite components with bond of a required strength can be economically mass-produced.

In the case of the toothed pulley or inner rotor, it can be divided, by the cylindrical surface of proper radius centered around the rotary shaft, into the outer part having the tooth profile and the inner part having the shaft hole. The inner part is made of weldable material like cast or wrought metal (hereinafter specifically called steel member) and the outer part is manufactured by powder metallurgy into a green compact. The inner part is fitted into the green compact and sintered in this state, thereby the sintered machine part having the advantages of powder metallurgy and being weldable to the rotary shaft or a plate part can be obtained.

According to this method, since the step of sintering the green compact also serves as the step of bonding with the steel member, the manufacturing process is simplified, and the cost is lower. In the case of a component in which the inner part has a complicated shape such as the outer rotor, to the contrary, the green compact by powder metallurgy is applied to the inner part and the wrought material to the outer part.

An example of wrought materials suited to welding is carbon steel S20C. When this carbon steel is used for one part, if the other part is formed of a ferriferous green compact having chemical composition of 1.5% copper, 0.7% graphite and the balance iron (green compact A), the green compact does not expand so much as the carbon steel during sintering. In contrast, if a ferriferous green compact having a composition of 3% copper, 0.5% graphite and the balance iron (green compact B) is used, this green compact expands more than the steel during sintering.

For the above carbon steel and the green compacts A and B, the state of thermal expansion by heat in each material will be described below. The measuring conditions are: heating in the nitrogen atmosphere up to 1,130° C. at a rate of 10° C. per minute; holding for 20 minutes; and cooling at the same rate.

First, in the case of carbon steel, i.e., molten material obtained by solidifying the melted one, the dimensional change is simply due to thermal expansion and shrinkage, excepting for those by allotropic transformation (shrinkage accompanying $\alpha$-$\gamma$ transformation in heating process and expansion accompanying $\gamma$-$\alpha$ transformation in cooling process), and if the temperature is normalized, the original dimensions are restored.

On the other hand, with the case of green compact A (becoming a sintered compact according as the sintering proceeds), it is the same that dimensional changes due to heat and allotropic transformation occur as in the case of a wrought material. However, in addition to the above, it is densified (or shrinks) due to change of gaps between powder particles by closing to form pores and then losing in the pores, as the phenomenon characteristic of sinter. This shrinkage cancels the expansion by heat, and the amount of expansion in high temperature region becomes smaller than in the carbon steel. Therefore, if an inner part made of carbon steel and an outer part made of green compact A are fitted together and sintered, the outer part tightens the inner part while sintering is promoted, so that diffusion occurs on the both parts to bond them firmly.

In this case, in order to avoid any slightest expansion, it is desired to use a non-carburizing atmosphere. In view of the economy as well, it is preferred to use nitrogen gas atmosphere, which is almost inert, or an atmosphere mainly composed of nitrogen gas, among various non-carburizing gases. Thus, without such means for promoting expansion, the green compact shrinks more than the steel member relatively. This material may be pure iron or substantially the same material as the steel member of the inner part. Unless the amount of thermal expansion is increased more than the steel member, proper alloying components can be contained, depending on the application.

In contrast, in the case of green compact B, since the copper content is large, the "Copper growth phenomenon" which is characteristic in sintering of the iron-copper alloy clearly appears, and the shrinkage due to sintering is canceled. Accordingly, the expansion amount in the high temperature region is increased more than in the carbon steel. Therefore, the green compact B is used as the inner part, and the carbon steel is as the outer part.

There are varieties in the method for setting the amount of expansion of the ferriferous green compact more than that of the steel member. One of them is the use of "Copper growth phenomenon" in the green compact B, and its effect is significant when blended at the copper content of 1% or more, and it is preferred for the purpose of diffusion bonding to blend at 2% or more, so as to make sufficient contact with the fitted outer part. Moreover, if the carbon content of the two parts differs by 0.2% or more, the amount of expansion of the high-carbon part (green compact) is larger than that of the low-carbon part.

Even when the carbon content is the same between the steel member and green compact, if they are sintered in the carburizing atmosphere, the amount of expansion of green compact becomes larger. Moreover, if the green compact sintered in the carburizing atmosphere contains zinc (zinc stearate, etc.), the amount of expansion of green compact is further increased. This is because the zinc shows a catalytic action even at a small amount and works so as to promote the carburizing action. Therefore, when the green compact as the inner part is fitted into the outer part, the above matters are effective means for expanding the inner part.

Formation of liquid phase by sintering and fit clearance of the two parts are same as mentioned in the above sections (A) and (B), and details are omitted.

EXAMPLES

Effects of Added Zinc in Sintering of Ferriferous Green Compact

First, in terms of the ratio by weight, a raw material powder composed of 1.5% of copper powder, 0.7% of graphite and the balance iron was mixed with 1.0% of zinc stearate, as a powder lubricant, relative to the raw material powder, to obtain a mixed powder P1. Moreover, the above process was repeated, excepting that the powder lubricant was substituted with lithium stearate at the same composition ratio as the mixed powder P1 to obtain mixed powder P2. Both powders were compressed and formed respectively, to obtain a green compact C1 containing zinc stearate and green compact C2 containing lithium stearate, of green density of 6.7 g/cm$^3$, respectively.

The green compact C1 and green compact C2 were individually applied in dilatometers, and heated in carburizing butane denatured gas atmosphere up to 1,130° C. at a rate of 10° C. per minute, held for 20 minutes, and cooled at the same rate. In this period, dimensional changes of the compacts relative to the green compacts before heating were measured, and the thermal expansion curves of both were obtained.

The initial portion of the thermal expansion curve showed a mere thermal expansion of sample, and both green compact C1 and green compact C2 expanded similarly. As sintering began, the expansion continued while the amount of thermal expansion was canceled by the portion of expansion accompanying sintering. At this time, in the green compact C1 including zinc, carburizing from the atmosphere seemd to occure so that shrinkage was suppressed, and the thermal expansion became greater than in the green compact C2, and the thermal expansion curve of the green compact C1 elevated higher.

Therefore, if using green compact C2 as the outer part, fitting with the green compact C1 as the inner part and sintering them in carburizing atmosphere, diffusion bonding is achieved by sintering since the inner part is relatively tightened by the outer part, so that they are integrated firmly.

Example 1

First, using a carbon steel S45C, a cylinder of 30 mm in outside diameter, 10 mm in inside diameter and 20 mm in length was prepared as an inner part.

Next, 1.5% of copper powder and 0.7% of graphite powder were blended to iron powder to obtain a material powder. Then 0.7% of Acra-Wax (tradename of an ethylene-bis-stera-amide $(C_{17}H_{35}CONH)_2(CH_2)_2$ product) was added as powder lubricant to this material powder, thereby mixed powder was prepared. Compressing this mixed powder, an annular plate green compact was formed as outer part at the outside diameter of 40 mm, inside diameter of 30 mm (intereference: 30 $\mu$m), thickness of 10 mm, and green density of 7.0 g/cm$^3$.

The both portions were fitted by press-fitting, and sintered in nitrogen atmosphere for 40 minutes at 1130 deg. C., and bonded integrally. The obtained sinter was set in a material testing machine, and the outside portion as supported on a stand, while the inside portion was loaded to perform breakage test. As a result, the bonding strength of both portions was 120 MPa.

Example 2

The material of the inner part in Example 1 was changed from the carbon steel to a steel SCM415 for machine structural use, and the material powder for forming the green compact of the outer part was changed to a partially diffused alloy powder composed of 1.5% copper, 4% Ni, 0.5% Mo and the balance Fe (manufactured and sold by Hoeganaes AB with tradename "Distaloy AE"). The powder lubricant was 0.7% of Acra-Wax same as in Example 1. The both parts were prepared in the same manner as in Example 1, excepting that the intereference was changed to 20 $\mu$m, and they were fitted by press-fitting and sintered for 115 minutes at 1,195° C. in a dissociated ammonia gas atmosphere, and bonded integrally. The sinter whole was evaluated by the same destructive test as in Example 1, and the bonding strength between both parts was 200 MPa.

Example 3

The material of the inner part was same as in Example 2 (SCM415), but the material powder for forming the green compact of the outer part was changed to a mixed powder obtained by adding 0.6% of graphite to an alloy powder in the composition of 2% Ni, 1.5% Mo and the balance Fe. The powder lubricant was 0.7% of Acra-Wax, and the inner part and the outer part were prepared same as in Example 2, and the both parts were fitted together by press-fitting at the intereference of 20 $\mu$m. They were sintered for 115 minutes at 1,195° C. in a dissociated ammonia gas atmosphere, and bonded integrally. The sintered product was evaluated by the same destructive test as in Example 1, and the bonding strength of both parts was 200 MPa.

Comparative Example 1

The manufacturing process of Example 1 was repeated, excepting that the powder lubricant was changed to 0.7% of zinc stearate, and the sintering atmosphere was changed to carburizing butane denatured gas, to obtain an outer part and inner part. Both parts were similarly fitted and sintered. However, the sintered product was not bonded partly between the contact surfaces of the both parts and was inferior in strength.

Comparative Example 2

When processing in the same conditions as in The manufacturing process of Comparative Example 1 was repeated, excepting that Acra-Wax (tradename) was used as the powder lubricant, the sintered product was bonded, but the bonding strength was poor at 40 MPa.

Example 4

A cylindrical inner part having an outside diameter of 30 mm, an inside diameter of 10 mm and a length of 20 mm was manufactured with use of a sintered compact composed of 1.5% copper, 0.7% carbon and the balance iron and having a sintered density of 7.0 g/cm$^3$.

Next, a material powder was prepared by blending 1.5% copper powder and 0.7% graphite powder into the balance iron powder, and it was mixed with 0.7% Acra-Wax (trade name of an ethylene-bis-stera-amide $(C_{17}H_{35}CONH)_2(CH_2)_2$ product) relative to the amount of the material powder, as a powder lubricant, to obtain a mixed powder. This mixed powder was compressed to form an annular plate, as an outer part, having an outside diameter of 40 mm, an inside diameter of 30 mm (interference=30 $\mu$m), a thickness of 10 mm and a green density of 7.0 g/cm$^3$.

The cylindrical inner part and the annular outer part were assembled by press-fitting the inner part into the bore of the outer part, and they were sintered at 1,130° C. for 40 minutes in a nitrogen atmosphere, thereby they were bonded. The sintered product as a specimen of composite machine components was subjected to a destructive test for measuring the bonding strength between the outer part and the inner part, using a material testing machine. In the destructive test, the outer part was supported on the table of the testing machine and load was applied to the inner part in the axial direction to break the bond between the both parts. As a result of measurement, the bonding strength was 120 MPa.

In this example, it is considered that sufficient strength has been imparted to the bonding because the outer part (green compact) was inhibited to relatively expand during the sintering, due to the use of non-carburizing atmosphere.

Example 5

The manufacturing process of Example 4 was repeated, excepting that the sintering atmosphere was changed to a butane denatured gas which had a carburizing property. The sintered product obtained above was subjected to the destructive test of Example 4, and as a result of measurement, the bonding strength of both parts was 110 MPa.

In this example, though the outer part (green compact) was likely to expand due to permeation of the carbulizing sintering atmosphere into the outer part, the inner part (sintered material) also similarly expanded due to the same atmosphere permeating through the interconnecting pores. Accordingly, the amounts of expansion were counterbalanced to each other, resulting in imparting such bonding strength as to almost equal that of Example 4.

This point is the difference between the case using a sintered material and that using a wrought material. Namely, if the inner part is made of a wrought material, such counterbalance as to provide sufficient bonding strength will not occur because of no pores to enable the carbulizable atmosphere to permeate into the inner part.

Example 6

For formation of the inner part, the manufacturing process of Example 4 was repeated, excepting that the inner part was formed of a sintered alloy composed of 1.5% copper, 4% nickel, 0.5% molybdenum and the balance iron and having a sintered density 7.0 g/cm$^3$. For the outer part, the manufacturing process of Example 4 was still repeated, but excepting that the outer part was formed from a mixed powder which was obtained by mixing a partially difused alloy powder (sold by Hoeganaes AB with a tradename "Distaloy AE") composed of 1.5% copper, 4% nickel, 0.5% molybdenum and the balance iron, with 0.7% Acra-Wax relative to the amount of the partially diffused alloy powder, and the interference was changed to 20 $\mu$m.

The cylindrical inner part and the annular outer part were assembled by press-fitting the inner part into the bore of the outer part, and they were sintered at 1,195° C. for 115 minutes in a dissociated ammonia gas atmospher, thereby they were bonded. The sintered product was subjected to the same destructive test as in Example 4. As a result, the bonding strength was 200 MPa.

This example and Example 4 have basically common grounds in that the outer part (green compact) did not contain zinc, and that the sintering atmosphere was non-carburizing. In this example, a still higher bonding strength has been exhibited due to differences in alloy composition of each part, sintering temperature and sintering time.

Example 7

For formation of the inner part, the manufacturing process of Example 4 was repeated. For the outer part, the manufacturing process of Example 4 was still repeated, but excepting that the outer part was formed from a mixed powder which was prepared by mixing a material powder which was obtained by blending 0.6% graphite powder into a powdered alloy composed of 2% nickel, 1.5% molybdenum and the balance iron, with 0.7% zinc stearate relative to the amount of the material powder, and the interference was changed to 20 $\mu$m.

The inner part and the outer part were assembled by press-fitting the inner part into the bore of the outer part with the intereference of 20 $\mu$m, and they were sintered at 1,195° C. for 115 minutes in a dissociated ammonia gas atmospher, thereby they were bonded. The sintered product was subjected to the same destructive test as in Example 4. As a result, the bonding strenght was 200 MPa.

Since also this example employed a sintering atmospher containing no carburizing component, the outer part (green compact) was not carburized in spite of zinc contained in the outer part, and high bonding strength similar to Example 6 has been exhibited.

Comparative Example 3

For formation of the inner part, the manufacturing process of Example 5 was repeated to obtain the same inner part (sintered material). For the outer part, the manufacturing process of Example 5 was still repeated, but excepting that the powder lubricant was changed to 0.7% zinc stearate, thereby obtaining an outer part (green compact) with an intereference of 30 $\mu$m.

The inner part and the outer part were assembled by press-fitting the inner part into the bore of the outer part with the intereference of 30 $\mu$m, and they were sintered at 1,130° C. for 40 minutes in a butane denatured gas which had a carburizing property. The sintered product was observed and it was found that most part of the contacting surface between the inner part and the outer part was not bonded. It was also insufficient in strength.

The reason of the above results resides in that the outer part was remarkably carbulized from the sintering atmosphere due to catalytic action of zinc, so that expansion amount of the outer part exceeded that of the inner part and the outer part expanded relative to the inner part. By comparing the results of this comparative example and Example 5, synergistic effect by using carburizing atmosphere and zinc in the green compact is clearly seen.

Example 8

With use of carbon steel S45C, an annular plate having an outside diameter of 36 mm, an inside diameter of 30 mm and a thickness of 10 mm was formed as an outer part. Next, a material powder was prepared by blending 3% copper powder and 5% graphite powder into the balance iron powder, and the material powder was mixed with 0.7% Acra-Wax (trade name of an ethylene-bis-stera-amide $(C_{17}H_{35}CONH)_2(CH_2)_2$ product) relative to the amount of the material powder as a powder lubricant, thereby obtaining a mixed powder. This mixed powder was compressed to form a cylindrical compact having an outside diameter of 30 mm (interference=20 $\mu$m), an inside diameter of 10 mm, a length of 20 mm and a green density of 7.0 g/cm$^3$ as an inner part.

The cylindrical inner part and the annular outer part were assembled by press-fitting the inner part into the bore of the outer part, and they were sintered at 1,130° C. for 40 minutes in a nitrogen atmosphere, thereby they were bonded. The sintered product as a specimen of composite machine components was subjected to a destructive test for measuring the bonding strength between the outer part and the inner part, using a material testing machine. In the destructive test, the outer part was supported on the table of the testing machine and load was applied to the inner part in the axial direction to break the bond between the both parts. As a result of measurement, the bonding strength was 120 MPa.

Example 9

With use of carbon steel S38C, an annular plate having an outside diameter of 36 mm, an inside diameter of 30 mm and a thickness of 10 mm was formed as an outer part. Next, a material powder prepared by blending 1.5% copper powder and 0.7% graphite powder into the balance iron powder was mixed with 0.7% zinc stearate relative to the amount of the material powder as a powder lubricant, thereby obtaining a mixed powder. This mixed powder was compressed to form a cylindrical compact having an outside diameter of 30 mm (interference=20 $\mu$m), an inside diameter of 10 mm, a length of 20 mm and a green density of 7.0 g/cm$^3$ as an inner part.

The cylindrical inner part and the annular outer part were assembled by press-fitting the inner part into the bore of the outer part, and they were sintered at 1,130° C. for 40 minutes in a nitrogen atmosphere, thereby they were bonded. The sintered product as a specimen of composite mechanical parts was subjected to a destructive test for measuring the bonding strength between the outer part and the inner part, using a material testing machine. In the destructive test, the outer part was supported on the table of the testing machine and load was applied to the inner part in the axial direction to break the bond between the both parts. As a result of measurement, the bonding strength was 100 MPa.

The results of Example 8 and Example 9 show that satisfactory bonding can be produced by the sintering in a nitrogen atmosphere. If the sintering atmosphere is substituted with a carburizing atmosphere, the effect will be increased.

Example 10

With use of carbon steel S38C, an annular plate having an outside diameter of 36 mm, an inside diameter of 30 mm and a thickness of 10 mm was formed as an outer part. Next, a material powder prepared by blending 1.5% copper powder and 0.4% graphite powder into the balance iron powder was mixed with 0.7% zinc stearate relative to the amount of the material powder as a powder lubricant, thereby obtaining a mixed powder. This mixed powder was compressed to form a cylindrical compact having an outside diameter of 30 mm (interference=30 $\mu$m), an inside diameter of 10 mm, a length of 20 mm and a green density of 7.0 g/cm$^3$ as an inner part.

The cylindrical inner part and the annular outer part were assembled by press-fitting the inner part into the bore of the outer part, and they were sintered at 1,130° C. for 40 minutes in a butane denatured gas atmosphere which had carburizing property, thereby they were bonded. The sintered product as a specimen of composite mechanical parts was subjected to a destructive test for measuring the bonding strength between the outer part and the inner part, using a material testing machine. In the destructive test, the outer part was supported on the table of the testing machine and load was applied to the inner part in the axial direction to break the bond between the both parts. As a result of measurement, the bonding strength was 150 MPa.

Comparative Example 4

The manufacturing process of Example 10 was repeated to obtain the same inner and outer parts, and similarly assembled parts were sintered at 1,130° C. for 40 minutes in nitrogen atmosphere.

The sintered product was subjected to the same destructive test as Example 10, using a material testing machine. As a result, the bonding strength was 10 MPa.

Example 11

An annular plate having an outside diameter of 36 mm, an inside diameter of 30 mm and a thickness of 10 mm was manufactured as an outer part, with use of a sintered compact composed of 1.5% copper, 0.7% carbon and the balance iron and having a sintered density of 7.0 g/cm$^3$.

Next, a material powder was prepared by blending 3% of copper powder and 0.5% of graphite powder into the balance of iron powder, and it was mixed with 0.7% Acra-Wax (trade name of an ethylene-bis-stera-amide $(C_{17}H_{35}CONH)_2(CH_2)_2$ product) relative to the amount of the material powder, as a powder lubricant, to obtain a mixed powder. This mixed powder was compressed to form a cylindrical inner part having an outside diameter of 30 mm (interference=20 $\mu$m), an inside diameter of 10 mm and a length of 20 mm and a green density of 7.0 g/cm$^3$, as an inner part.

The cylindrical inner part and the annular outer part were assembled by press-fitting the inner part into the bore of the outer part, and they were sintered at 1,130° C. for 40 minutes in a nitrogen atmosphere, thereby they were bonded. The sintered product as a specimen of composite mechanical parts was subjected to a destructive test for measuring the bonding strength between the outer part and the inner part, using a material testing machine. In the destructive test, the outer part was supported on the table of the testing machine and load was applied to the inner part in the axial direction to break the bond between the both parts. As a result of measurement, the bonding strength was 120 MPa.

In this example, it is considered that sufficient bonding strength was obtained, because expansion of the inner part (green compact) was enhanced by "Copper growth phenomenon" in the iron—copper system so that the inner part tightly fitted to the outer part, while the sintering proceeded.

Example 12

As an outer part, an annular plate of the same dimensions as in Example 11 was manufactured with use of a sintered compact composed of 1.5% copper, 0.4% carbon and the balance iron and having a sintered density of 7.0 g/cm$^3$.

Next, a material powder was prepared by blending 1.5% of copper powder and 0.7% of graphite powder into the balance of iron powder, and it was mixed with 0.7% zinc stearate relative to the amount of the material powder, as a powder lubricant, to obtain a mixed powder. This mixed powder was compressed to form a cylindrical inner part of the same dimensions as in Example 11 and having a green density of 7.0 g/cm$^3$.

The cylindrical inner part and the annular outer part were assembled by press-fitting the inner part into the bore of the outer part, and they were sintered at 1,130° C. for 40 minutes in a nitrogen atmosphere in the similar manner to Example 11, thereby they were bonded. The sintered product was subjected to the same destructive test as in Example 11 for measuring the bonding strength. As a result, the bonding strength was 70 MPa.

In this example, the inner part expanded more due to the difference of the carbon contents of the outer and inner parts. The results of Example 11 and Example 12 show that satisfactory bond can be produced by the sintering in a nitrogen atmosphere. If the sintering atmosphere is substituted with a carburizing atmosphere, the effect will develop more.

Example 13

For the outer part, the manufacturing process of Example 12 was repeated to obtain the same annular plate.

Moreover, for the inner part, the manufacturing process of Example 12 was repeated, excepting that the powder lubricant was substituted with the same amount of Acra-Wax, and that the intereference was changed to 30 μm, thereby obtain a cylindrical inner part.

The cylindrical inner part and the annular outer part were assembled by press-fitting the inner part into the bore of the outer part with the intereference of 30 μm, and they were sintered at 1,130° C. for 40 minutes in a butane denatured gas atmosphere which had carbulizing property, thereby they were bonded. The sintered product was subjected to the same destructive test as in Example 11 for measuring the bonding strength. As a result, the bonding strength was 80 MPa.

In this example, the effect developing on the inner part not only includes that by the difference of carbon contents of poth parts, but also that by carburization with the atmosphere. However, since the latter one also develops on the outer part (sintered alloy) by the atmosphere permeating into the outer part through the interconnecting pores, expansion due to carbulization with the atmosphere is counterbalanced between both parts. Accordingly, increase of the bonding strength is only a small amount.

The above point is the difference between the case with use of a sintered material and that of a wrought material. If the outer part is made of a wrought metal, permeation of the carburizing atmosphere through pores is impossible and such offset of expansion as mentioned above does not occur.

Example 14

For the outer part, the manufacturing process of Example 12 was repeated to obtain the same annular plate.

For the inner part, a material powder was prepared by blending 1.5% copper powder and 0.4% graphite powder into the balance iron powder so as to have the same composition as that of the outer part, and it was mixed with 0.7% zinc stearate relative to the amount of the material powder, as a powder lubricant, to obtain a mixed powder. This mixed powder was compressed to form a cylindrical inner part of the same dimensions as in Example 13 and having a green density of 7.0 g/cm$^3$.

The cylindrical inner part and the annular outer part were assembled by press-fitting the inner part into the bore of the outer part with the intereference of 30 μm, and they were sintered at 1,130° C. for 40 minutes in a butane denatured gas atmosphere which had carbulizing property, thereby they were bonded. The sintered product was subjected to the same destructive test as in Example 11 for measuring the bonding strength. As a result, the bonding strength was 120 MPa.

In this example, carbulization of the inner part with the sintering atomosphere was accelerated by the catalytic action of zinc which was contained in the inner part (green compact) but not contained in the outer part (sintered material), so that the inner part expanded relative to the outer part during the sintering, thereby the bonding strength increased.

Example 15

For the outer part, the manufacturing process of Example 12 was repeated to obtain the same annular plate.

For the inner part, the manufacturing process of Example 12 was repeated, excepting that the powder lubricant was changed to 0.7% Acra-Wax relative to the amount of the material powder, and that the intereference was 20 μm, to obtain a cylindrical inner part.

The cylindrical inner part and the annular outer part were assembled by press-fitting the inner part into the bore of the outer part with the intereference of 20 μm, and they were sintered at 1,130° C. for 40 minutes in a butane denatured gas atmosphere which had carbulizing property, thereby they were bonded. The sintered product was subjected to the same destructive test as in Example 11 for measuring the bonding strength. As a result, the bonding strength was 150 MPa.

In this example, the bonding strength has reached a remarkably high level by synergistic effect of differential carbon contents as shown in Example 12 and of accelerated carbulization with zinc as shown in Example 14.

Comparative Example 5

The manufacturing process of Example 14 was repeated to obtain an inner part of a green compact and an outer part of a sintered material which were the same in material quality, dimensions, intereference, etc., as Example 14.

The cylindrical inner part and the annular outer part were assembled by press-fitting the inner part into the bore of the outer part, and they were sintered at 1,130° C. for 40 minutes in a nitrogen atmosphere. The sintered product was subjected to the same destructive test as in Example 11 for measuring the bonding strength. As a result, the bonding strength was 10 MPa.

In this case, though the inner part (green compact) contained zinc as a component of the powder lubricant, the sintering atmosphere contained no carburizing components. Therefore, expansion by carburization did not occur. Moreover, "copper growth phenomenon" nor expansion by differential carbon contents did not occure, either. Accordingly, both parts did not tightly contact to each other during the sintering. That is considered as the reason why the bonding strength did not sufficiently increase.

Comparative Example 6

The manufacturing process of Example 14 was repeated, excepting that the powder lubricant for the inner part was substituted with 0.7% Acra-wax, to obtain an inner part of a green compact and an outer part of a sintered material which were the same in dimensions and intereference as Example 14.

The cylindrical inner part and the annular outer part were assembled by press-fitting the inner part into the bore of the outer part with the intereference of 30 μm, and they were sintered at 1,130° C. for 40 minutes in a nitrogen atmosphere. The sintered product was subjected to the same destructive test as in Example 11 for measuring the bonding strength. As a result, the bonding strength was 10 MPa.

This case has the same ground as Comparative Example 5 in that "copper growth phenomenon" nor expansion by differential carbon contents did not occur. The expansion by carburization with atmosphere was not effective either, because it was so small with no presence of zinc in the green compact that was offset by the expansion of the outer part.

Example 17

Assuming manufacture of sintered gear having a weldable shaft hole portion, the following operation was carried out.

First, a cylinder of carbon steel S20C (18 mm in outside diameter, 10 mm in inside diameter, 12 mm in length) was prepared as an inner part. Next, to a material powder of 1.5% of copper, 0.7% of graphite and the balance of iron, 0.7% of Acurawax (tradename) was added as powder lubricant, and the obtained mixed powder was formed into an annular plate at outside diameter of 40 mm, inside diameter of 18 mm (interference: 30 μm), length of 12 mm, and green density of 7.0 g/cm$^3$, and the outer part was obtained.

The inner part was press-fitted into the outer part, and both were sintered for 40 minutes in nitrogen atmosphere at 1130° C. The sintered product was set in a material testing machine, and the outer part as supported on a stand, while the inner part was loaded to perform destructive test. As a result, the bonding strength of both parts was 120 MPa.

Example 18

Assuming a machine component of which the inner circumferencial part is of a sintered material, having complicated shape, and of which the outer circumferencial part is of a weldable material, the following operation was carried out.

First, an annular plate of carbon steel S20C (30 mm in inside diameter, 36 mm in outside diameter, 15 mm in thickness) was prepared as an outer part. Next, a material powder was obtained by blending 3% of copper, 0.5% of graphite to the balance of iron, and this was mixed with 0.7% of Acra-Wax (tradename). This was compressed into a cylindrical inner part at the green density of 7.0 g/cm$^3$, outside diameter of 30 mm (intereference: 10 μm), inside diameter of 20 mm, and length of 15 mm.

The both parts were fitted by press-fitting (intereference fitting with fitting clearance (minus value of intereference) of −10 μm), and sintered for 40 minutes at 1,130° C. in nitrogen atmosphere. The strength of the sintered product was measured, and the bonding strength of the both parts was 110 MPa.

Example 19

The manufacturing process of Example 18 was repeated excepting that the material powder for forming the inner part was changed to have a composition ratio of 1.5% copper, 0.7% graphite and the balance iron, thereby preparing an inner part and an outer part. The inner part and the outer part fitted by press-fitting were sintered for 40 minutes at 1,130° C. in butane denatured gas atmosphere. The strength of the obtained sinter was measured, and the bonding strength of the both parts was 110 MPa.

Example 20

The same outer part as in Example 18 was prepared. Further, using a mixed powder obtained by adding 0.7% of zinc stearate as powder lubricant to the material powder in the composition of 1.5% copper, 0.4% graphite and the balance iron, the inner part was obtained by compacting it into a cylinder at green density of 7.0 g/cm$^3$, outside diameter of 30 mm (intereference: 20 μm), inside diameter of 20 mm, and length of 15 mm.

This inner part was fitted with the outer part by press-fitting at the intereference of 20 μm, and sintered for 40 minutes at 1,130° C. in butane denatured gas atmosphere. The strength of the obtained sinter was measured, and the bonding strength of the both portions was 120 MPa.

The strength obtained in each of the above examples was sufficient as the value for machine components, and the object of combining a portion of sintered alloy and a portion of weldable material has been achieved successfully.

According to the construction of the present invention, it is clear what are the bar for selecting alloy composition in each part of the composite component and appropriate combinations of the powder lubricant and the sintering atmosphere. Therefore, the bonding strength of the both parts of the composite component can be remarkably improved.

Moreover, since a bonding of sufficient strength can be produced by using the general sintering conditions, the manufacturing cost is reduced and productivility is improved.

Since carburization for steel materials is unnecessary, the manufacturing cost and productivility are improved. It is also possible to bond the both parts even when a material for which carburization is unpreferable or which is not suitable for carurization treatment is used for the raw material. Therefore, the application area of the composite component obtained according to powder metallurgy is enlarged.

Moreover, it is possible to manufacture a composite component which is substantially uniform as a whole.

The bonding of a portion of green compact and the steel material which is weldable is completed simultaneously in one process of sintering and alloying of green compact, so that sintered machine components having desired welding performance can be manufactured economically.

It must be understood that the invention is in no way limited to the above embodiments and that many changes may be brought about therein without departing from the scope of the invention as defined by the appended claims.

What is claimed is:

1. A method of manufacturing a machine component of sintered ferriferous composite comprising an outer part having a hole and an inner part having a shaft which is fitted into the hole of the outer part, comprising the steps of: preparing one of the outer part and the inner part as a green compact of ferriferous powdered metal and the other as one of a green compact of ferriferous powdered metal, a sintered compact of ferriferous powdered metal and a mass of ferriferous molten metal; inserting the shaft of the inner part into the hole of the outer part; and sintering the outer part and the inner part to bond the outer part and the inner part, wherein the outer part and the inner part are prepared to have a fitting clearance of approximately −60 to +5 μm, and when only the outer part is prepared as a green compact, the outer part is prepared to contain substantially no zinc, or the atmosphere at the sintering step is substantially non-carburizing atmosphere, and, when the inner part is prepared as a green compact, the outer and inner parts are prepared so that only the inner part contains zinc, and the atmosphere at the sintering step is substantially carburizing atmosphere.

2. The manufacturing method of claim 1, wherein both of the outer part and the inner part are prepared as a green compact.

3. The manufacturing method of claim 1, wherein only the outer part is prepared as a green compact.

4. The manufacturing method of claim 1, wherein only the inner part is prepared as a green compact, and the fitting clearance of the outer part and the inner part is approximately −40 to +5 μm.

5. The manufacturing method of claim 1, wherein the substantially non-carburizing atmosphere comprises nitrogen gas.

6. The manufacturing method of claim 1, wherein the substantially carburizing atmosphere is refined exothermic gas.

7. The manufacturing method of claim 6, wherein the purified exothermic gas includes butane denatured gas.

8. The manufacturing method of claim 1, wherein the inner part is prepared as a green compact, and the inner part contains 2% by weight or more of copper.

9. The manufacturing method of claim 1, wherein the inner part is prepared as a green compact, and the inner part contains carbon at a content which is higher by 0.2% by weight or more than the outer part.

10. The manufacturing method of claim 1, wherein said the other is prepared as a mass of ferriferous molten metal which has weldability.

11. A method of manufacturing a machine component of sintered ferriferous composite comprising an outer part having a hole and an inner part having a shaft which is fitted into the hole of the outer part, comprising the steps of: preparing both of the outer part and the inner part as a green compact of ferriferous powdered metal; inserting the shaft of the inner part into the hole of the outer part; and sintering the outer part and the inner part to bond the outer part and the inner part, wherein the outer part and the inner part are prepared to have a fitting clearance of approximately −100 to +5 $\mu$m, the outer part contains substantially no zinc but the inner part contains zinc, and the atmosphere at the sintering step is substantially carburizing atmosphere.

12. The manufacturing method of claim 11, wherein the substantially carburizing atmosphere is refined exothermic gas.

13. The manufacturing method of claim 12, wherein the purified exothermic gas includes butane denatured gas.

* * * * *